US009062670B2

(12) United States Patent
Fritsch

(10) Patent No.: US 9,062,670 B2
(45) Date of Patent: Jun. 23, 2015

(54) DIAPHRAGM MACHINE WITH A PLURALITY OF PUMP CHAMBERS

(75) Inventor: Horst Fritsch, Leonberg (DE)

(73) Assignee: ProMinent GmbH, Heidelberg (DE)

( * ) Notice: Subject to any disclaimer, the term of this patent is extended or adjusted under 35 U.S.C. 154(b) by 93 days.

(21) Appl. No.: 13/380,280

(22) PCT Filed: Aug. 3, 2010

(86) PCT No.: PCT/EP2010/061305

§ 371 (c)(1),
(2), (4) Date: Dec. 22, 2011

(87) PCT Pub. No.: WO2011/018394

PCT Pub. Date: Feb. 17, 2011

(65) Prior Publication Data

US 2012/0100022 A1 Apr. 26, 2012

(30) Foreign Application Priority Data

Aug. 11, 2009 (DE) ..... 10 2009 039 175

(51) Int. Cl.
*F04B 43/067* (2006.01)
*F04B 43/02* (2006.01)
(Continued)

(52) U.S. Cl.
CPC ..... *F04B 43/023* (2013.01); *F04B 43/06* (2013.01); *F04B 43/0733* (2013.01); *F04B 43/0736* (2013.01)

(58) Field of Classification Search
CPC ..... F04B 43/06; F04B 43/067; F04B 43/073; F04B 43/0736; F04B 45/053; F04B 45/0533; F04B 45/0536; F04B 43/0733
USPC ..... 417/317, 413.1, 472, 473, 383, 388, 417/390, 394, 395; 92/96; 60/536, 581
See application file for complete search history.

(56) References Cited

U.S. PATENT DOCUMENTS 2,383,193 A 8/1945 Herbert
2,657,636 A * 11/1953 Schmidt ..... 417/347
(Continued)

FOREIGN PATENT DOCUMENTS

CA 1327132 C 7/2007
CN 1399070 A 2/2003
(Continued)

OTHER PUBLICATIONS

H. Fritsch, "Innovation in der Pumpen-technik," Industriepumpen & Kompressoren, Sep. 2008, pp. 143-148 (with machine translation thereof).
(Continued)

*Primary Examiner* — Devon Kramer
*Assistant Examiner* — Nathan Zollinger
(74) *Attorney, Agent, or Firm* — Drinker Biddle & Reath LLP

(57) ABSTRACT

A diaphragm machine including a drive unit for producing pulsating hydraulic fluid flows for driving the diaphragms, and a delivery unit for delivering a delivery medium and having pump chambers with volumes that can be varied by the movement of a respective diaphragm. Each pump chamber is connected by a pressure valve to a pressure line and by a suction valve to a suction line. The delivery unit includes at least two hydraulic bodies and a diaphragm body in which the pressure and suction lines are arranged. Each hydraulic body is connected to the drive unit, and formed between each hydraulic body and the diaphragm body is a cavity in which one of the diaphragms is arranged so that by production of the pulsating hydraulic fluid flows, the diaphragms are moved within the cavities and the delivery medium is periodically transferred from the suction line into the pressure line.

10 Claims, 5 Drawing Sheets

(51) Int. Cl.
*F04B 43/06* (2006.01)
*F04B 43/073* (2006.01)

(56) References Cited

U.S. PATENT DOCUMENTS

| | | | | | |
|---|---|---|---|---|---|
| 2,821,930 | A | * | 2/1958 | Smith | 417/317 |
| 3,659,966 | A | * | 5/1972 | Faber | 417/395 |
| 4,856,966 | A | * | 8/1989 | Ozawa | 417/214 |
| 5,332,372 | A | * | 7/1994 | Reynolds | 417/393 |
| 5,368,451 | A | * | 11/1994 | Hammond | 417/395 |
| 6,419,463 | B1 | * | 7/2002 | Bahrton | 417/395 |
| 6,846,166 | B2 | * | 1/2005 | Kinugawa | 417/395 |

FOREIGN PATENT DOCUMENTS

| | | | | |
|---|---|---|---|---|
| DE | 39 42 981 | | | 7/1991 |
| EP | 0 959 247 | | | 11/1999 |
| GB | 681139 | A | * | 10/1952 |
| JP | 2001241379 | A | | 9/2001 |
| WO | 99/25999 | | | 5/1999 |

OTHER PUBLICATIONS

International Search Report issued on Nov. 3, 2010 in International PCT Application No. PCT/EP2010/061305 filed Aug. 3, 2010.

* cited by examiner

DIAPHRAGM MACHINE WITH A PLURALITY OF PUMP CHAMBERS

CROSS REFERENCE TO RELATED APPLICATIONS

This application is a National Stage of International Application No. PCT/EP2010/061305 filed Aug. 3, 2010, and which claims benefit of German Patent Application No. 10 2009 039 175.4 filed Aug. 11, 2009, both of which are herein incorporated by reference in the entirety.

The present invention concerns a multi-cylinder diaphragm machine having at least two hydraulically driven diaphragms comprising: a drive unit for producing at least two pulsating hydraulic fluid flows for driving the diaphragms and a delivery unit for delivering a delivery medium and having at least two delivery chambers, the volumes of which can be varied by the movement of a respective diaphragm, wherein each delivery chamber is connected by way of a pressure valve to a pressure line and by way of a suction valve to a suction line.

The significance of multi-cylinder diaphragm machines, in particular process diaphragm pumps and diaphragm compressors for the industry involving industrial processing engineering has increased greatly in recent years as the pollutant emissions of production installations have to be increasingly further reduced. That requirement applies to many pumps and compressors used in industrial processing engineering. The larger the power units thereof are and the more environmentally polluting the fluids to be conveyed, the correspondingly more difficult it becomes to gain control over the problem of leakage and disposal thereof. In recent years therefore intensive endeavors have been undertaken to push forward the development of leak-free processing machines in the direction of larger power units.

For many fluids which are delivered or pumped as reaction components in particular in chemical industrial processing engineering, the maximum admissible emission values (MAK values) were in the meantime set at such a low level by the legislator that leak-free machines are absolutely necessary. The consequence of this was that the conventional piston machine had to be replaced by diaphragm machines, in particular for high pressure processes. Nowadays however diaphragm machines are also increasingly used for less dangerous fluids. Inter alia the following advantages are involved with diaphragm machines:

- the operational reliability and availability, higher than the piston machine, by virtue of the almost wear-free hydraulic-piston sealing arrangement, long diaphragm service life, leak-free reliable diaphragm rupture signaling and integrated total safeguard against excess pressure and subpressure,
- the low operating costs as a consequence of the low maintenance expenditure and energy requirement. Thus for example by virtue of the extremely low friction and leakage of its piston sealing arrangement which runs in hydraulic oil the hydraulic diaphragm pump has the highest energy efficiency of all known types of pump,
- those properties have had the result that, in terms of investment planning of installations, the decisions taken are increasingly frequently to the favor of diaphragm pumps. Their higher purchase price in comparison with other structures is often already amortized after a short operating time due to the higher availability, that is to say due to minimum stoppage times of the installation, and the advantageous operating costs.

Older piston machines are frequently replaced by diaphragm machines in the modernization of existing installations, in particular when this involves components which are difficult to convey such as for example liquid gases, solid-bearing fluids or chemically aggressive fluids, to reduce costly stoppage times and maintenance and repair costs or to eliminate leakages which can no longer be tolerated. Usually large diaphragm machines are constructed in the form of multi-cylinder machines, wherein the individual diaphragm heads are generally driven by oscillatingly operating crank drive mechanisms. The drive mechanism and the individual diaphragm heads in that case form a structural unit, wherein the crank drive mechanism is either of a monoblock type or is of a modular structure.

The disadvantage of that concept is on the one hand that it cannot be sufficiently flexibly adapted to the local conditions, such as for example available space or admissible weight, while on the other hand it requires expensive collecting lines on the suction and pressure side in order to connect together the individual diaphragm heads which are separate from each other.

A further disadvantage of the conventional kind of structure is that the diaphragm is only accessible with difficulty in a service situation. Upon a change in diaphragm or when replacing the valves the suction-side and pressure-side conduits wetted by the fluid to be delivered have to be released from the diaphragm head so that the wearing components to be replaced, such as for example diaphragms or valves, are accessible at all. Particularly in the case of large high-pressure diaphragm machines that involves a considerable complication and expenditure.

Considered overall the disadvantages of the known structures are substantially as follows:

- large amount of space required
- high weight
- high material consumption
- inadequate adaptability to local conditions
- lack of service-friendliness
- high price
- incompletely utilized potential for maximizing energy efficiency Examples of such multi-cylinder diaphragm machines are shown in DE 39 42 981 and U.S. Pat. No 5,368,451.

Taking the described state of the art as the basic starting point the object of the invention is to provide a multi-cylinder diaphragm machine which avoids or at least alleviates the specified disadvantages, which is extremely compact and thus saves on space and material, has a high energy efficiency, a high degree of flexibility in adaptation to the conditions at the installation location and with which at the same time it is ensured that mounting and dismantling of the individual diaphragms and valves are easily possible.

According to the invention that object is attained by a multi-cylinder diaphragm machine of the kind set forth in the opening part of this specification, in which the delivery unit comprises a diaphragm body in which the pressure and suction lines are arranged and at least two hydraulic bodies, wherein each hydraulic body is connected to the drive unit, wherein formed between each hydraulic body and the diaphragm body is a cavity in which one of the diaphragms is arranged so that by production of the pulsating hydraulic fluid flows the diaphragms are moved within the cavities and a delivery medium is periodically transferred from the suction line into the pressure line.

The above-mentioned problems and disadvantages are eliminated in a simple fashion by the multi-cylinder diaphragm machine according to the invention insofar as there is a clear separation between the drive unit and the delivery unit and thus each of the two units can be optimized in its structural configuration independently of each other. The two units are coupled by connecting lines which transmit the pulsating hydraulic fluid flows produced by the hydraulic drive, that is to say the drive unit, to the delivery unit of the diaphragm machine by way of the diaphragm bodies.

That concept makes it possible to impart an extremely compact form which saves on material and space to the components of the delivery unit which generally consist of high-quality expensive materials and which are wetted by the fluid being delivered.

In addition the delivery unit can be so designed that a diaphragm change does not require removal of any other components which are wetted by the fluid being delivered and the costly collecting conduits which interconnect the individual diaphragm heads on the suction and pressure sides are greatly reduced or can even be entirely eliminated. The drive unit can be for example in the form of an eccentric sliding unit drive mechanism which makes it possible for all piston rods to be disposed in one common plane, whereby both the bending moment in the eccentric shaft and also the bearing forces in the case of a three-cylinder machine are reduced to a third of the values occurring with conventional crank drive mechanisms of an in-line structure. The structural size can be drastically reduced in that way.

A further advantage of the eccentric sliding guide drive mechanism is that it has a very high energy efficiency and thus makes a contribution to saving energy.

The arrangement according to the invention of the delivery unit comprising a substantially centrally arranged diaphragm body and hydraulic bodies which are fixed thereto or thereon and between which is formed a cavity in which one of the diaphragms is arranged so that the diaphragm subdivides the cavity into a hydraulic chamber connected to the pulsating hydraulic fluid flows and the delivery chamber.

Advantageously the hydraulic bodies are arranged at the outside of the diaphragm body so that the diaphragm can be accessed by removing the hydraulic body from the diaphragm body and the diaphragm can possibly be replaced.

In a preferred embodiment the diaphragm body forms a central block, wherein the diaphragm body is either in one piece or comprises a plurality of pieces which together with a connecting portion form a central block. The latter variant is admittedly somewhat more expensive and complicated to manufacture but it enjoys the advantage that the central block can be made from a less expensive material than the other parts of the diaphragm body which come into contact with the medium being delivered and therefore must meet special demands.

In a further preferred embodiment the components provided for controlling and monitoring the diaphragm machine such as for example a pressure limiting valve, a continuous degassing valve, a leak make-up valve or a hydraulic fluid storage chamber are arranged in the drive unit. The more those components are integrated into the drive unit, the correspondingly more compact can the delivery unit be.

It is further provided in a preferred embodiment that all suction lines and all pressure lines in or on the diaphragm body are connected together, preferably each in a collecting portion, so that the diaphragm body is connected to the exterior only with one pressure line and only with one suction line. That measure reduces the costs for the provision of the suction and pressure lines. Thus for example the delivery unit can have a top side, an underside and peripherally extending side surfaces, wherein the hydraulic bodies are arranged at the peripherally extending side surfaces and one or more collecting portions can then be arranged at the top side or the underside.

Generally the multi-cylinder diaphragm machine is of such a design configuration that pulsating hydraulic fluid flows of equal strength are fed to the diaphragms, wherein the pulsating hydraulic fluid flows are phase-displaced relative to each other to ensure that significant delivery occurs in any position of the drive piston which is present in the drive unit.

In a further preferred embodiment the delivery unit is in the form of a two-stage diaphragm compressor and both stages have a common diaphragm body, wherein preferably a valve serves both as the pressure valve of the first stage and also as the suction valve of the second stage.

A further preferred embodiment provides that the drive unit is arranged over the delivery unit, that is to say at a geodetically higher point.

In addition it is basically advantageous for the hydraulic bodies to be so arranged that the hydraulic lines from the hydraulic bodies to the drive unit are as short as possible and as much as possible of the same length to keep the influences of the lines as low and as uniform as possible.

Further advantages, features and possible uses will be apparent from the description hereinafter of some embodiments by way of example and the associated Figures in which.

Figure 1:
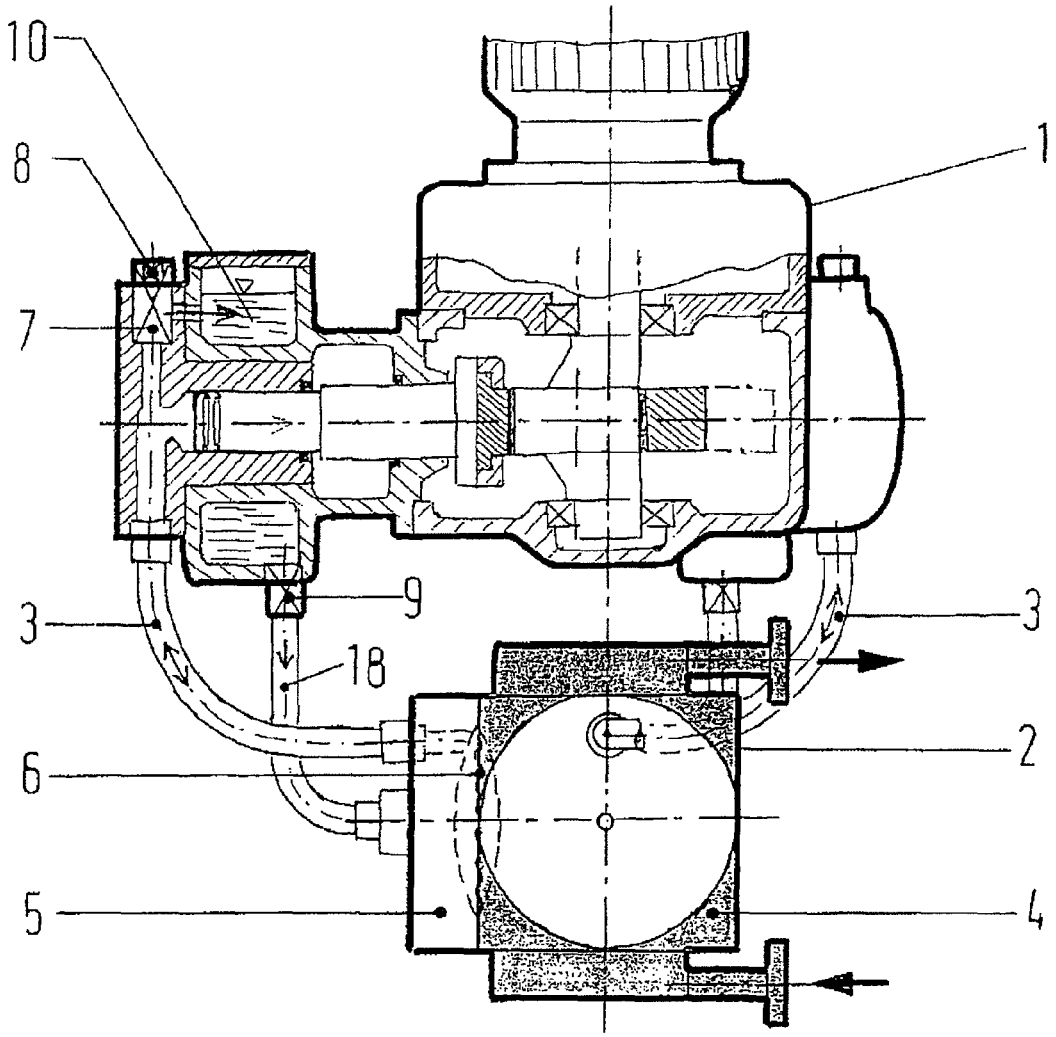
FIG. 1 shows a multi-cylinder diaphragm machine according to the invention.

FIG. 1 shows an embodiment of a multi-cylinder diaphragm machine according to the invention comprising a drive unit 1, a delivery unit 2 and the hydraulic lines connecting the delivery unit and the drive unit. The delivery unit 2 is composed of the diaphragm body 4 which is contacted by the fluid to be delivered, the hydraulic bodies 5 and the diaphragms 6. The hydraulic bodies 5 are mounted to the outside surface of the diaphragm body 4. Both the hydraulic bodies and also the diaphragm bodies each have a respective recess so that, when a hydraulic body is fitted on the diaphragm body, there is a cavity between the diaphragm body and the hydraulic body 5. Fitted in that cavity is the diaphragm 6 which subdivides the cavity into two chambers 16, namely the delivery chamber and the hydraulic chamber. The delivery chamber is thus substantially formed by the diaphragm and the recess in the diaphragm body while the hydraulic chamber is formed by the recess formed in the hydraulic body and the diaphragm. When now the pressure in the hydraulic chamber is increased by a rise in pressure in the hydraulic lines 3 by virtue of the operation of the drive unit 1 the diaphragm 6 will bend so that the hydraulic chamber becomes larger and the delivery chamber smaller. The delivery medium in the delivery chamber is now delivered for the major part into the pressure line by way of the pressure valve. When the pressure in the hydraulic medium falls again the diaphragm will deform in the other direction so that the delivery chamber is then larger in volume. Further delivery medium is then brought into the delivery chamber from the suction line by way of the suction valve.

The drive unit 1 includes the components normally integrated in the delivery unit 2, in the illustrated example these are a pressure limiting valve 7, a continuous degassing valve 8, a leak make-up valve 9 and a hydraulic fluid supply chamber 10.

That means that the delivery unit can be extremely compact. It will be appreciated that it would be possible, if that should be required by a specific use, for a part of the specified components to be also integrated into the delivery unit, even if that would increase the structural size of the delivery unit again.

Figure 2:
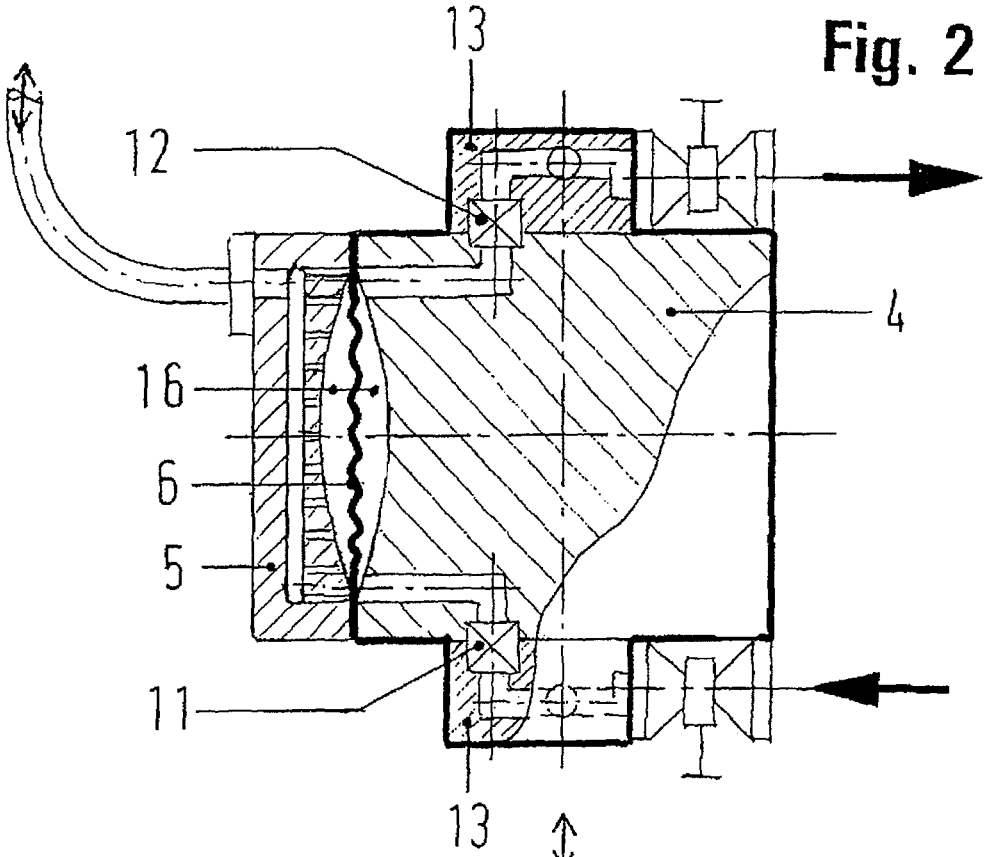
FIG. 2 shows a section of a delivery unit.
Figure 3:
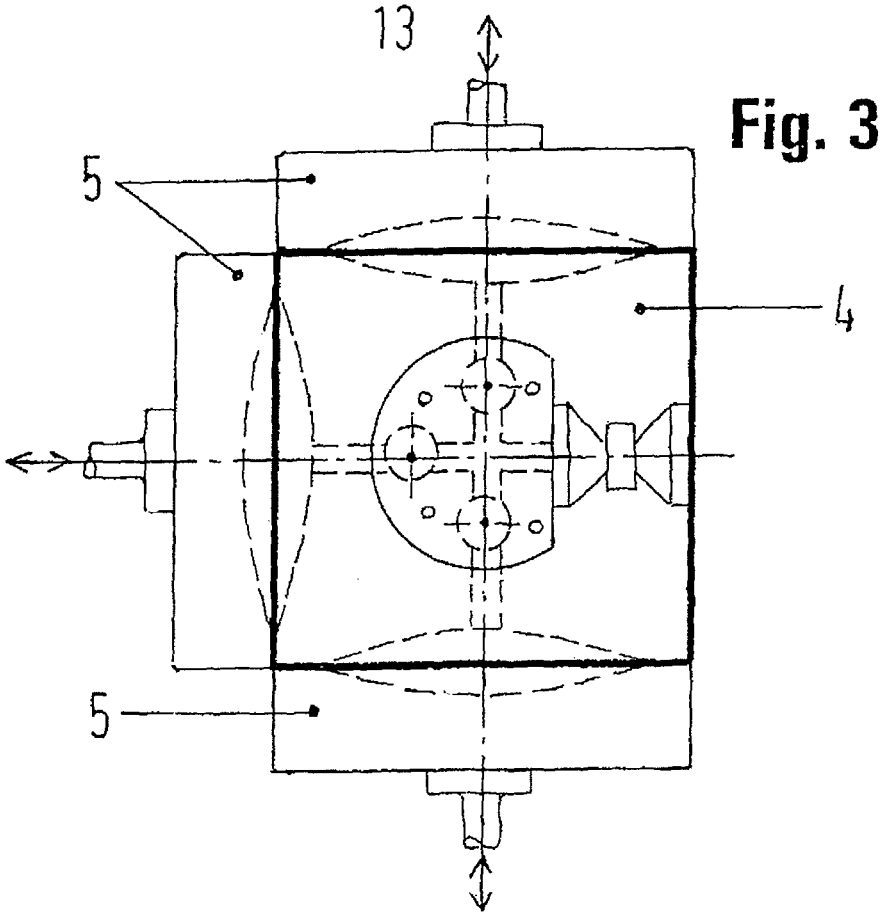
FIG. 3 shows a view from above of a delivery unit.

The delivery unit is shown once again on an enlarged scale in two sectional views in FIGS. 2 and 3. It will be seen that all components touched by the fluid to be delivered are arranged in a diaphragm body block 4. The hydraulic bodies 5 are arranged at the periphery thereof in such a way that the diaphragms 6 can be replaced with a slight level of complication and expenditure, that is to say without removal of the components touched by the fluid.

The suction valves 11 and pressure valves 12 are respectively connected to the diaphragm body by a collecting portion 13 so that the usual costly collecting conduits can be omitted and the valves are also easily accessible.

Figure 4:
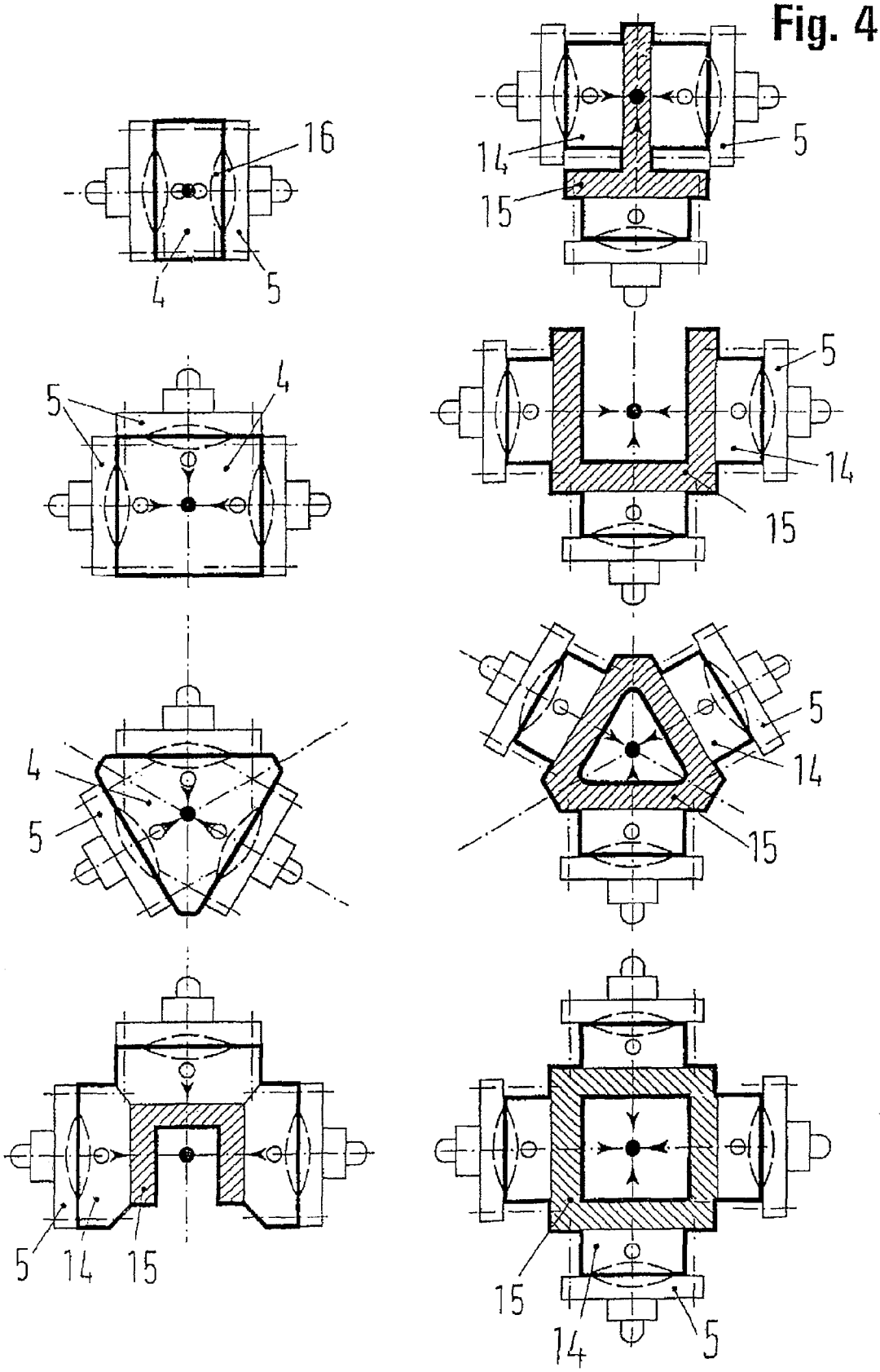
FIG. 4 shows various embodiments of the compact delivery unit.

FIG. 4 shows various configurations of the delivery unit as sectional views, in which the diaphragm body block 4 is either in one piece (see the uppermost 3 embodiments on the left-hand side in FIG. 4) or comprise individual parts 14 assembled by a connecting portion 15 to afford a block.

In all those embodiments there is a center about which the individual hydraulic bodies 5 are arranged. The hydraulic bodies thus all lie in one plane.

Figure 5:
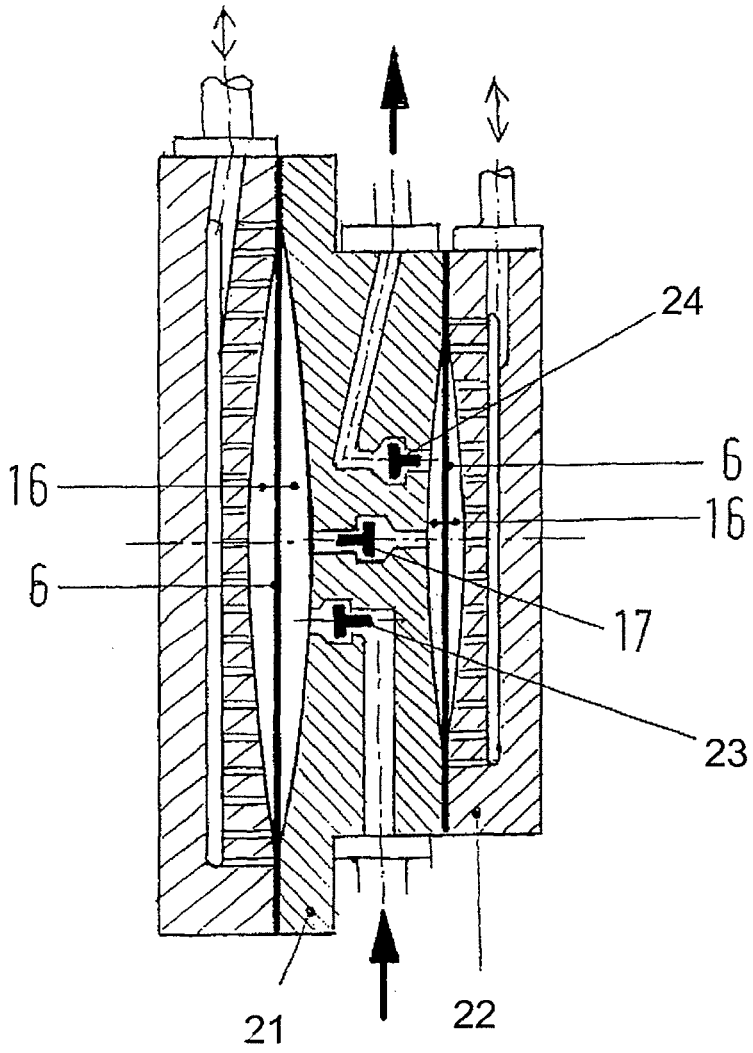
FIG. 5 shows an embodiment of the delivery unit of a two-stage diaphragm compressor.

As a further variant FIG. 5 shows a structure which is intended for diaphragm compressors and in which the diaphragm bodies 4 form a two-stage valve, wherein the pressure valve of the stage 1 which is formed by the first diaphragm body element 21 and the suction valve of the stage 2 which is formed by the second diaphragm body element 22 are embodied by a single valve 17. In contrast to usual structures, that makes it possible to implement a particularly compact structure which saves on material and weight and involves minimal harmful spaces in the delivery chamber of the diaphragm body 4.

Figure 6:
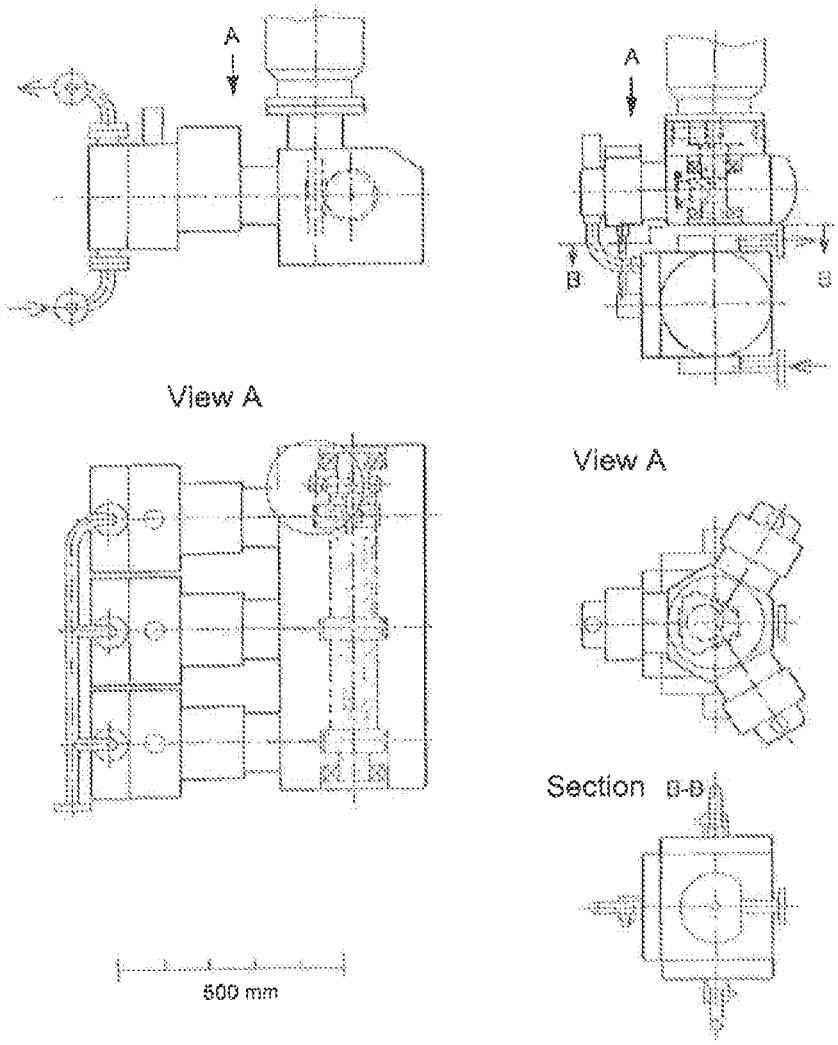
FIG. 6 shows a size comparison true to scale between a conventional diaphragm pump and an embodiment of the diaphragm pump according to the invention.

To clearly show the advantages of the invention, FIG. 6 illustrates a comparison, true to scale, between a conventional diaphragm pump with crank drive mechanism 19 (left-hand side in FIG. 6) and a diaphragm pump 20 according to the invention with an eccentric sliding unit drive mechanism of the same drive element output (right-hand side in FIG. 6). It will be clearly seen that the delivery unit is markedly more compact so that it can be used even when the amount of space involved is tight. The drive unit can then be arranged separately by way of the hydraulic lines.

Generally the pulsating hydraulic fluid flows delivered by the drive unit will be the same for all pressure chambers of the diaphragm bodies and the working chambers are of the same volume.

Nonetheless for certain situations of use it may be advantageous if the pump chambers are of different volumes and are acted upon with hydraulic fluid flows of differing strength.

It is also advantageous if the connection of the connecting conduit between the delivery unit 2 and the drive unit 1 is arranged at the geodetically highest location of the hydraulic chamber 5.

It may also be advantageous if the leak make-up valves 9 arranged in the drive unit 1 are connected by means of a pipe or a hose 18 to the hydraulic chamber 5 of the delivery unit 2.

LIST OF REFERENCES

1 drive unit
2 delivery unit
3 hydraulic line
4 diaphragm body
5 hydraulic body
6 diaphragm
7 pressure limiting valve
8 continuous degassing valve
9 leak make-up valve
10 hydraulic fluid supply chamber
11 suction valve
12 pressure valve
13 collecting portion
14 individual parts
15 connecting portion
16 chambers
17 valve
18 hose
19 crank drive mechanism
20 diaphragm pump
21 first diaphragm body element
22 second diaphragm body element
23 suction valve of the first stage
24 pressure valve of the second stage

The invention claimed is:

1. A multi-cylinder diaphragm machine having at least three hydraulically driven diaphragms comprising:

a drive unit for producing at least three pulsating hydraulic fluid flows for driving the diaphragms; and a delivery unit comprising one diaphragm body and at least three hydraulic bodies arranged at the outside of the one diaphragm body so that each diaphragm can be accessed by dismantling the hydraulic body from the one diaphragm body for replacing the diaphragm, wherein each of the at least three hydraulic bodies is connected to the drive unit;

wherein formed between each hydraulic body and the one diaphragm body is a cavity in which a respective diaphragm is arranged, wherein each diaphragm divides its respective cavity into two pump chambers, one of the two pump chambers being a delivery chamber for delivering a delivery medium, each delivery chamber being connected by way of a pressure valve to a corresponding pressure line and by way of a suction valve to a corresponding suction line, wherein the pressure and suction lines and the pressure and suction valves are arranged in the one diaphragm body;

wherein by production of the pulsating hydraulic fluid flows, the diaphragms are moved within the respective cavities and the delivery medium is periodically transferred from the suction line into the pressure line.

2. The multi-cylinder diaphragm machine as set forth in claim 1, wherein the one diaphragm body forms a central block, wherein the one diaphragm body is either in one piece or comprises a plurality of pieces which together with a connecting portion form a central block.

3. The multi-cylinder diaphragm machine as set forth in claim 1, wherein components provided for controlling and monitoring the diaphragm machine are arranged in the drive unit.

4. The multi-cylinder diaphragm machine as set forth in claim 1, wherein all suction lines and all pressure lines in the one diaphragm body are connected together such that the one diaphragm body is connected to the exterior only with one inlet and only with one outlet, respectively.

5. The multi-cylinder diaphragm machine as set forth in claim 1, wherein the drive unit is of such a configuration that pulsating hydraulic fluid flows of differing strength are fed to the diaphragms.

6. The multi-cylinder diaphragm machine as set forth in claim 1, wherein the one diaphragm body has a top side, an underside and peripherally extending side surfaces and the hydraulic bodies are arranged at the peripherally extending side surfaces.

7. The multi-cylinder diaphragm machine as set forth in claim 3, wherein the components for controlling and monitoring the diaphragm machine include at least one of a pressure limiting valve, a continuous degassing valve, a leak make-up valve, and a hydraulic fluid storage chamber.

8. The multi-cylinder diaphragm machine as set forth in claim 4, wherein all the suction lines and all the pressure lines in the one diaphragm body are connected together in a respective collecting portion.

9. The multi-cylinder diaphragm machine as set forth in claim 6, wherein the drive unit is arranged over the delivery unit.

10. The multi-cylinder diaphragm machine as set forth in claim 1, wherein the multi-cylinder diaphragm machine comprises at least three diaphragm heads driven by oscillatingly operating crank drive mechanisms.

* * * * *